US005735494A

United States Patent [19]

Kurk

[11] Patent Number: 5,735,494

[45] Date of Patent: Apr. 7, 1998

[54] BAG HOLDER

[76] Inventor: Robert Kurk, 3034 Wynstom Dr., Sebring, Fla. 33872

[21] Appl. No.: 612,242

[22] Filed: Mar. 7, 1996

[51] Int. Cl.[6] ..... A63B 55/04

[52] U.S. Cl. ..... 248/97; 248/156

[58] Field of Search ..... 248/97, 99, 100, 248/101, 166, 170, 156

[56] References Cited

U.S. PATENT DOCUMENTS

| | | | |
|---|---|---|---|
| Re. 33,842 | 3/1992 | Ebentheuer | 248/97 |
| 653,305 | 7/1900 | Mallard | 248/97 |
| 1,145,297 | 7/1915 | Erickson et al. | 248/97 |
| 1,405,846 | 2/1922 | Iverson | 248/97 |
| 1,542,164 | 6/1925 | Nelson | 248/97 |
| 1,727,448 | 9/1929 | Schario et al. | 248/97 |
| 2,472,410 | 6/1949 | Fenell et al. | 248/97 |
| 2,710,883 | 2/1955 | De Fazio | 248/95 X |
| 2,788,947 | 4/1957 | Kleiser | 248/97 |
| 2,995,329 | 8/1961 | Talcott et al. | 248/97 |
| 3,532,314 | 10/1970 | Voshikian | 248/97 |
| 3,679,160 | 7/1972 | Ballenger | 248/101 X |
| 3,707,271 | 12/1972 | Sanchez et al. | 248/101 |
| 3,804,355 | 4/1974 | Uroshevich | 248/170 X |
| 4,461,441 | 7/1984 | Briggs | 248/100 |
| 4,593,879 | 6/1986 | Seely et al. | 248/170 X |
| 4,702,445 | 10/1987 | Ivory | 248/100 |
| 4,708,216 | 11/1987 | Spiess | 248/99 X |
| 4,927,104 | 5/1990 | Miller | 248/97 |
| 4,940,201 | 7/1990 | Kurth | 248/101 |
| 5,190,253 | 3/1993 | Sable | 248/97 |
| 5,320,227 | 6/1994 | Minoura | 248/166 X |
| 5,503,356 | 4/1996 | Shelby | 248/166 X |

*Primary Examiner*—Ramon O. Ramirez
*Attorney, Agent, or Firm*—Middleton & Reutlinger; Charles G. Lamb

[57] ABSTRACT

A collapsible bag holder is provided with a vertically extending support member, ground mountable at one end and at an opposite end a pair of pivotally attached transversely extending collapsible bags holding members are provided. Locking means are provided for the collapsible bag holding members so that the bag holding members may be locked in a preselected horizontally extending angular position for receipt of the mouth end of a collapsible bag which will be supported in its upright, open position with the bottom of the bag resting upon the ground.

17 Claims, 7 Drawing Sheets

BAG HOLDER

BACKGROUND OF THE INVENTION a) Field of the Invention.

This invention relates to a bag holder and particularly to a bag holder for a bag to receive leaves, trash, and grass and other debris from a lawn area.

b) Description of the Prior Art.

In the past there have been many different types of devices proposed for the collection of leaves, grass trimmings and other debris from cleaning up a lawn or yard area. These devices have taken on many forms, including specially designed hard plastic containers wherein leaves and grass trimmings are swept inside and lids placed thereon as well as a number of devices to support leaf bags on a lawn for collection of leaves, grass trimmings and other debris. Two specific patents of interest include U.S. Pat. No. 2,472,410 and U.S. Pat. No. 3,679,160.

U.S. Pat. No. 2,472,410 teaches a sack holder comprising an adjustable vertically extending telescopic members and adjustable horizontally extending members. A base is provided for receiving one of the vertical extending members and the member received within the base is provided with a vertically extending slot to receive one end of a second vertical member therein for positioning the second member in telescoping relation with the first member. Moreover, the adjustable horizontally extending members are received in axial alignment in each end of a third stationary horizontal member which is mounted onto the upper end of the telescoping vertically extending members. Specific means are provided in the horizontal members for positioning the adjustable members at preselected positions thereby defining the length of the horizontal holding portion of the sack holder.

U.S. Pat. No. 3,679,160 teaches a litter bag holder which comprises a vertically extending pole with a spike portion therein wherein the spike portion is for insertion of the vertical pole into the ground. A bag holder member is assembled on the upper end of the vertically extending pole so as to be pivotable between a horizontal position and an idle or storage position that is substantially in line with the pole in its vertical position.

SUMMARY OF THE INVENTION

The present invention provides a trash bag holder which is compact for easy storage, quickly and easily assembled in a use position. The present invention also provides a trash bag holder which includes a vertically extending post member with a support means on one end thereof and a pair of side rods on opposite sides of the vertically extending support pivotally attached and when swung into a horizontally extending position can be locked in an angularly disposed horizontally extending position. Further, the present invention provides a trash bag holder for various sizes of plastic bags for collecting leaves, grass and the like.

More particularly, the present invention provides a collapsible bag holder comprising:

- a longitudinally extending support means having a ground support end and a bag support end opposite said ground support end;
- a pair of pivotally mounted bag support arms mounted on opposite sides of said bag support end of said longitudinally extending support means; and,
- a ground support assembly attached to said ground support end.

BRIEF DESCRIPTION OF THE DRAWINGS

A better understanding of the invention will be had upon reference to the following description in conjunction with the accompanying drawings in which the numerals refer to like parts throughout the several views and wherein.

DETAILED DESCRIPTION OF THE PREFERRED EMBODIMENT

Figure 1:
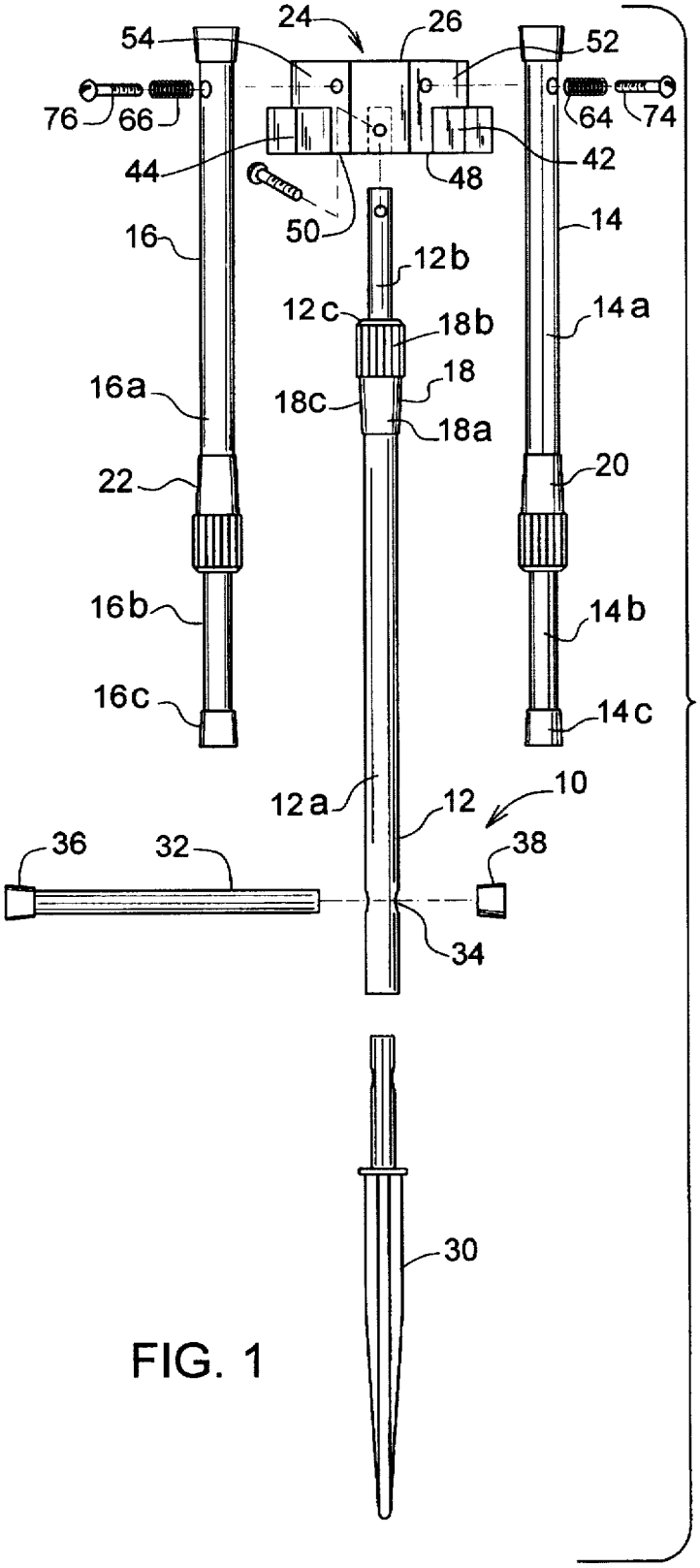
FIG. 1 is an exploded view of one preferred embodiment of the present invention.
Figure 4:
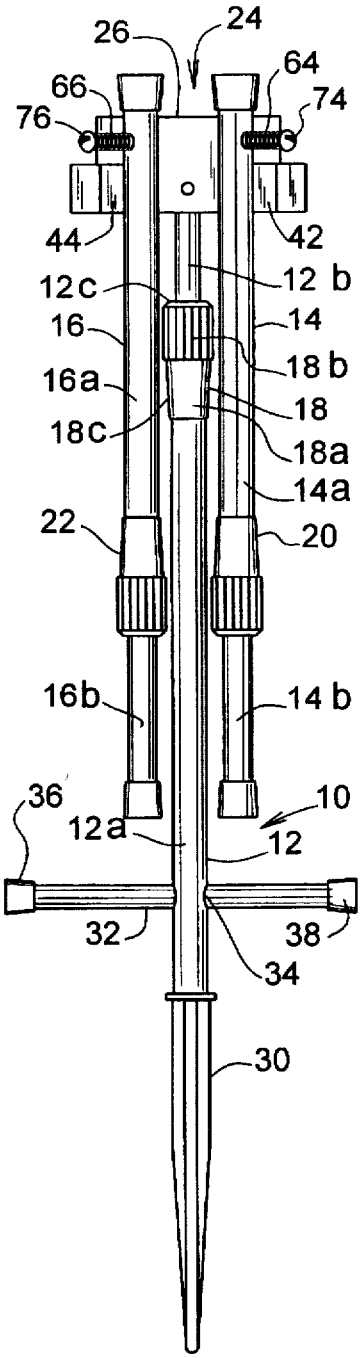
FIG. 4 is a plan view of the trash bag holder of FIG. 1 in a storage position.

With reference to FIG. 1, there is shown one trash bag holder, generally denoted as the numeral 10, of the present invention. The bag holder 10 includes a longitudinally extending support portion 12 shown as a telescoping tubular support which includes a lower tubular ground end member **12*a* and an upper tubular bag support end member 12*b* wherein the lower member 12*a* has a larger diameter than the upper member 12*b* and receives said upper member 12*b* therein. Preferably tubular members 12*a*, 12*b* are of circular cross-section. A locking device 18 is provided to lock the upper member 12*b* into the lower member 12*a* at a preselected position. Locking device 18 may be any known locking device known for locking telescoping parts in a preselected position. In the embodiment as shown in FIG. 1, locking device 18 includes a pair of mating collars 18*a*, 18*b* wherein collar 18*a* is provided with a male threaded connection and collar 18*b* is provided with a female threaded connection. Collar 18*a* is also provided with an elongated tapered end 18*c* which upon tightening of collar 18*a* into coupling 18*b* compresses against the end 12*c* of the rod 12*b* thereby holding rod 12*b* in a fixed position in rod 12*a*. Moreover, it is realized that the support portion 12** may be of preselected length and non-adjustable.

Tubular bag support arms 14 and 16 are pivotally attached to opposite sides of a pivot assembly 24, to be discussed hereinafter, which is mounted onto the upper end of member **12*b*. The horizontal tubular support arms 14 and 16 are preferably of circular cross-section and have a telescoping relationship wherein bag support arm 14 includes a first tubular support member 14*a* which receives a second tubular member 14*b* therein and bag support arm 16 includes a first tubular member 16*a* which has a diameter sufficiently greater than the diameter of a second tubular member 16*b* so as to receive the second tubular member 16*b* therein. Caps 14*c* and 16*c* are provided on the outer end of tubular members 14*b* and 16*b*, respectively, to protect users when scraping against said outer ends. Locking device 20, which may be any known in the art for locking telescoping parts in a preselected position, is provided for locking the position of the first tubular member 14a and the second tubular member 14b. Also, the bag support arm 16 also includes a locking assembly 22 which is disposed for locking the position of the tubular member 16a and the tubular member 16b. Preferred locking devices 20 and 22 are the same type as locking device 18** described hereinbefore.

Also provided at the lower end of the vertical support 12 is a means for inserting the vertical support 12 into the ground. One preferred means for supporting the vertical support 12 in the ground is a spike 30 which has an opening sized to receive the lower end of the lower tubular member 12a therein. The lower tubular member 12a may be held within the spike 30 by any known means such as friction, adhesives, screws which extend through the spike and into the tube, or any other well known fastening means.

A horizontal cross bar 32 is also provided to receive a user's foot in order to force the spike 30 of the trash bag holder into the ground. The horizontal cross bar 32 is received through appropriately sized aligned openings 34 in the lower tubular member 12a. Caps 36 and 38 are provided on each end of the horizontal cross bar to prevent injury to persons who scrape against the ends of the cross bar 32.

Pivot assembly 24 is shown as a trapezoidal shaped block member 26 mounted onto the upper end of tubular member 12b. Block 26 is provided with outwardly extending flange portions 42, 44 on opposite sides thereof for supporting the tubular members 14, 16, respectively, in a horizontal use position. Support flange portions 42, 44 preferably extend upwardly from horizontal edges 48, 50 of block 26 a distance less than the length of vertical sides 52, 54, respectively. Usually the distance from the upper most portion of flange portions 42, 44 to the upper terminating end of sides 52, 54 is equal to or greater than the outer diameter of the tubular members 14a, 16a, respectively. Moreover, the outwardly extending thickness of the flange portions 42, 44 is equal to or slightly less than the outer diameter of the tubular members 14a, 16a, respectively.

Figure 2:
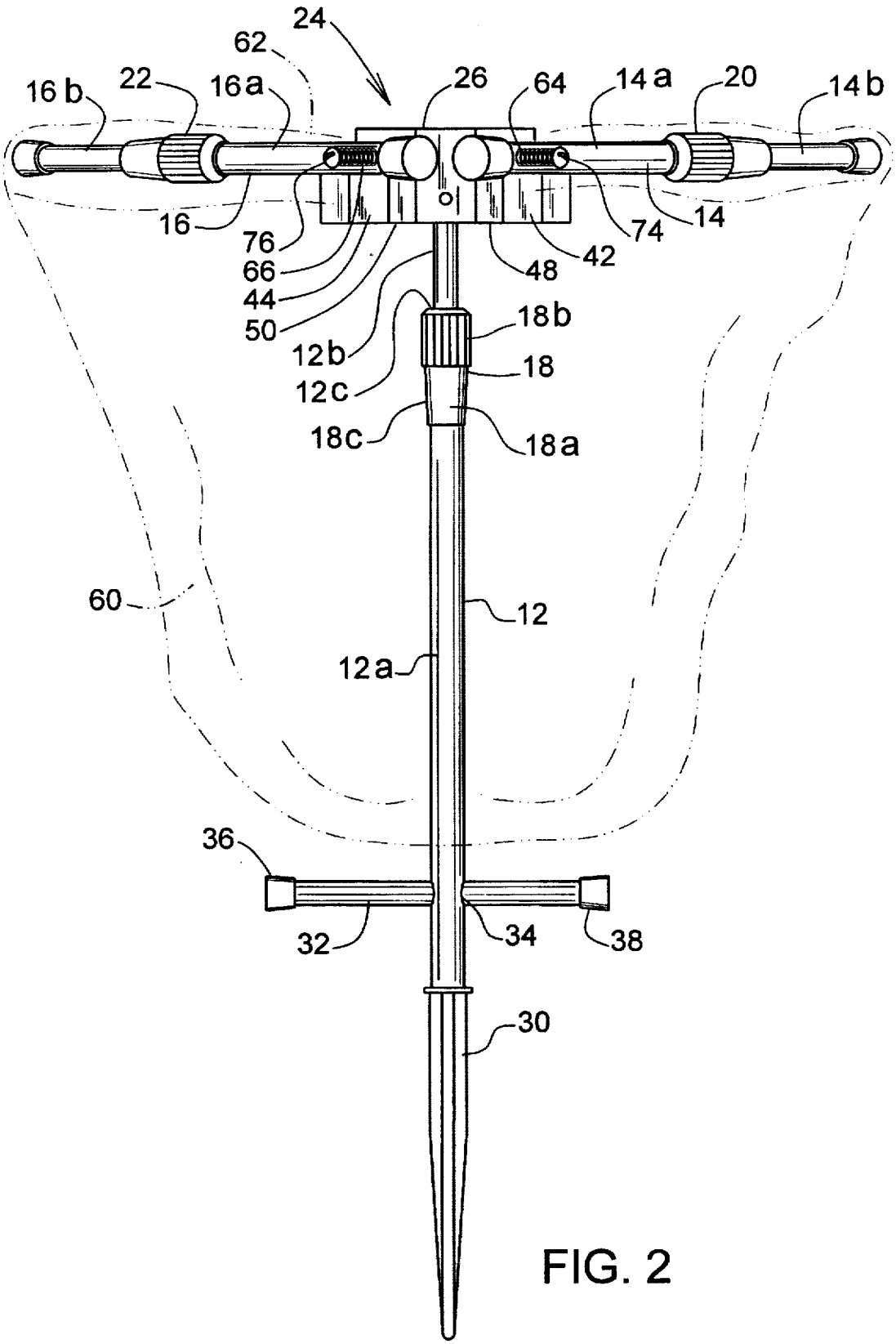
FIG. 2 is a plan view of the trash bag holder of FIG. 1.

In the embodiment as shown in FIGS. 1 and 2, non-parallel edges 48 and 50 are angularly disposed in relation to each other so that a collapsible bag can be mounted onto and between bag support arms 14 and 16 thereby holding the mouth end of a collapsible bag in an open position. A preferred angular relationship between arms 14 and 16 is about 60°, as shown in FIG. 3, but other angular relationships between arms 14 and 16 may also be used.

Figure 3:
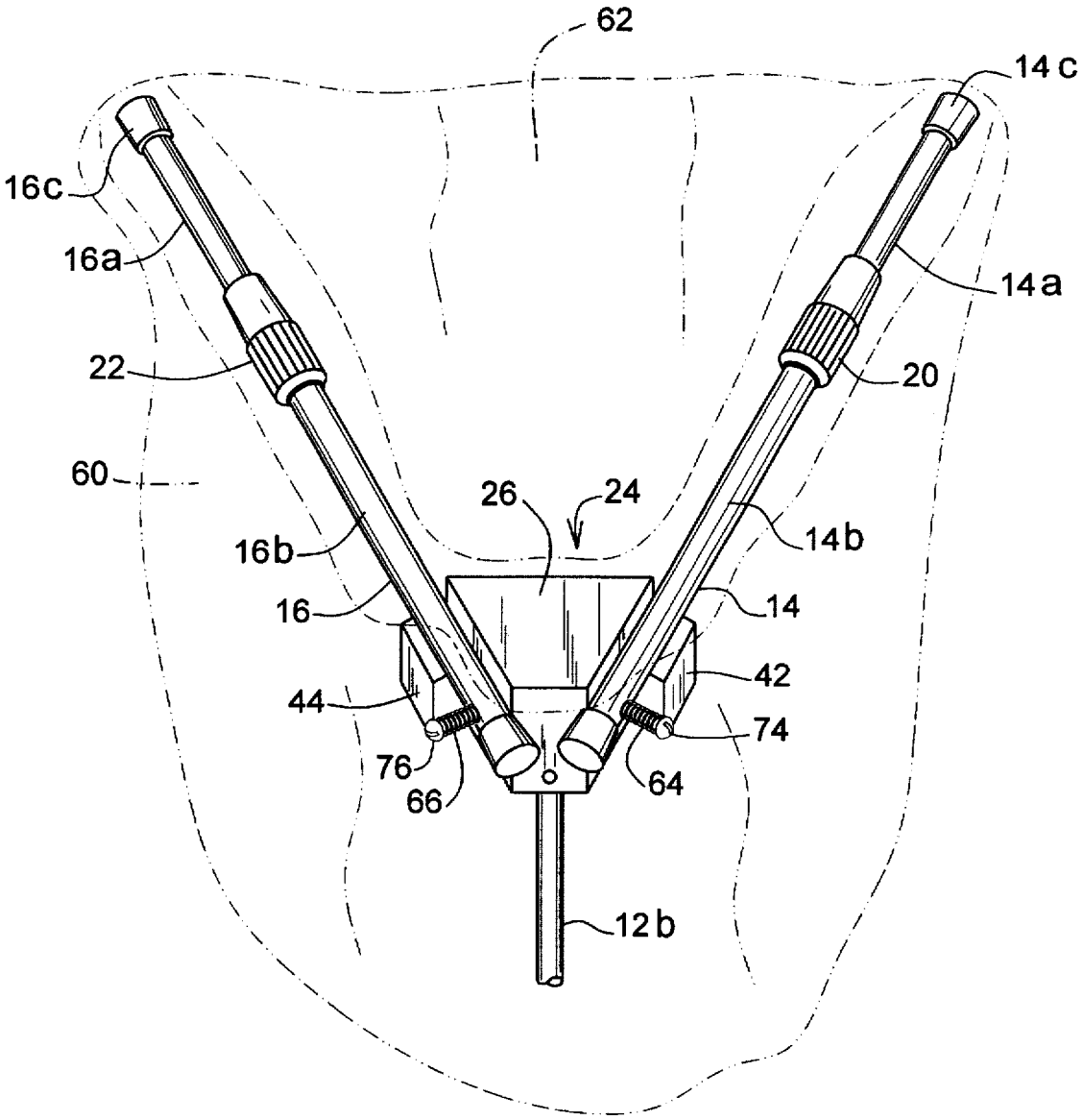
FIG. 3 is a perspective view of the top of the trash bag holder of FIG. 1.

As best shown in FIG. 3, tubular members 14a and 16a are pivotally attached to the trapezoidal shaped pivot assembly 26 by bolts 74, 76 with compression springs 64, 66, respectively. Tubular members 14a and 16a, respectively, are provided with aligned apertures therein which are sized to receive the bolts 74, 76 therethrough and the pivot assembly 26 is also provided with threaded apertures to receive the bolts 74, 76.

In construction, the compression springs 64, 66 are placed upon the bolts 74, 76, respectively, and the threaded end of the bolts are passed through the appropriate mating apertures on the tubular members 14a and 16a and then inserted into the appropriate apertures in the block 26. Bolts 74, 76 are of sufficient length so that in use the tubular members 14b, 16b can be held vertically to the sides of the vertical support 12 in one position and then in a horizontal use position, can be passed over the flanged portions 42, 44 and then supported thereon in a horizontal use position.

In use, arms 14 and 16 are swung upwardly into a horizontal use position and locked at preselected length positions by locking devices 20 and 22. The vertical support rod 12 is also locked at a preselected height which is usually a few inches less than the length of a collapsible bag to be mounted thereon. A collapsible bag 60, as shown in phantom lines in FIG. 2 and 3, is provided with an opening 62 at one end thereof which is wrapped over rods 14 and 16 with the ends of rods 14 and holding the mouth in an expanded open position with the opening in the bag being substantially triangular in shape.

Figure 5:
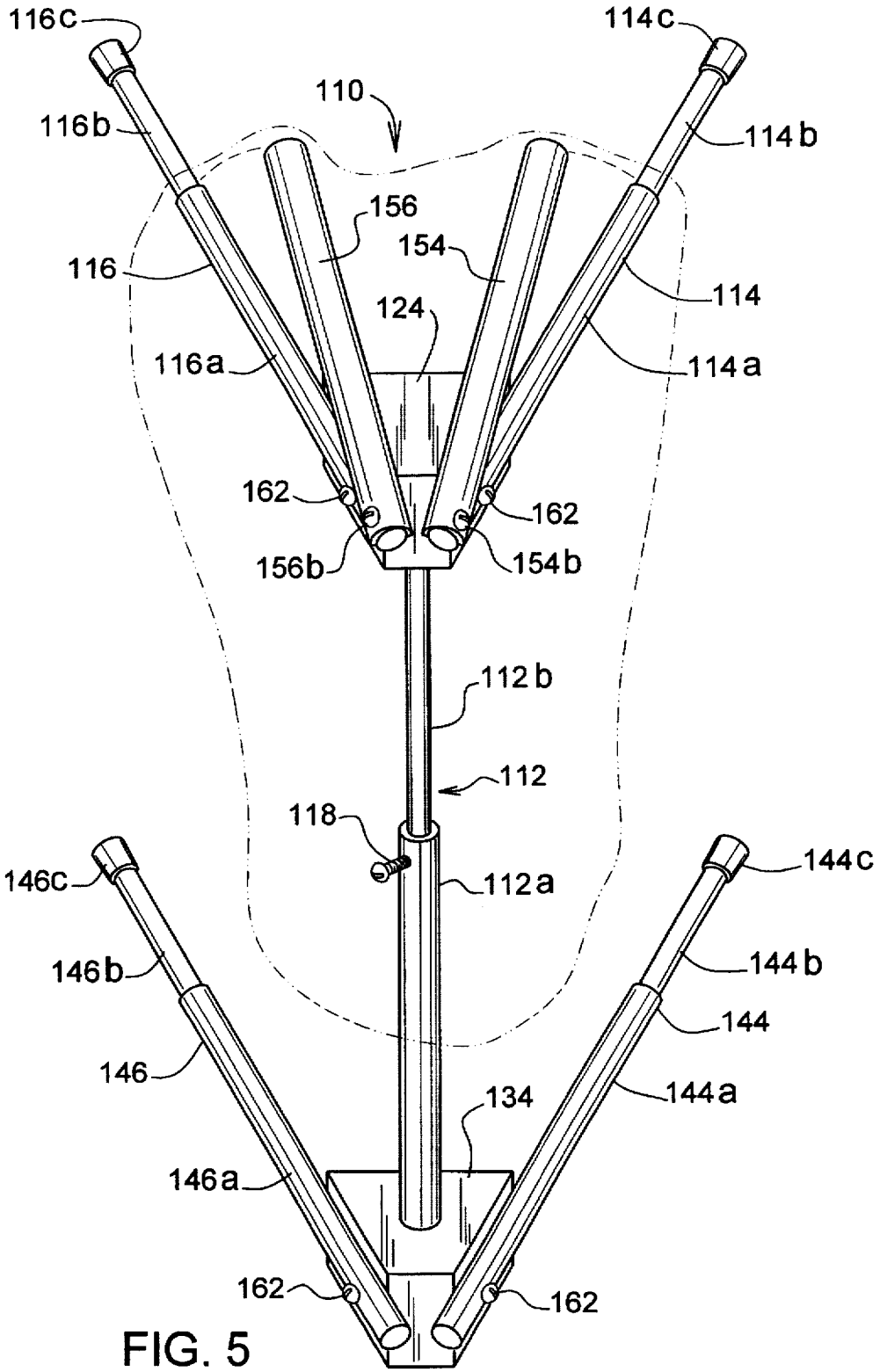
FIG. 5 is a perspective view of another preferred embodiment of the present invention.

Now turning to FIGS. 5–8, there is shown another preferred embodiment of a bag holder of the present invention. As best shown in FIG. 5, the bag holder is denoted by the numeral 110. The bag holder 110 includes a longitudinally extending support 112 which includes two tubular support members 112a and 112b in telescoping relationship. The lower or ground end tubular support member is identified by the numeral 112a and the upper or tubular bag support end member is identified by the numeral 112b. The lower member 112a has a larger diameter than the upper member 112b and receives said upper member 112b therein. Preferably, and as shown, the tubular members 112a and 112b are of circular cross-section. It is realized that other cross-sectional configurations, such as rectangular tubular members, may also be used. Moreover, support 112 may be unitary in construction and non-adjustable.

When support 112 is in two sections, a locking device is provided for locking the telescoping tubular members 112a and 112b into a preselected position which is generally determined by the size of a bag, such as the bag outlines shown in phantom lines in FIG. 5. The locking device consists of a threaded bolt member 118 and an opening having cooperating female threads (not shown) in tubular member 112. In using the locking device, the positioning of the tubular member 112b into 112a is generally selected so that a collapsible bag, such a leaf bag, is situated with its bottom end resting firmly on the ground.

Figure 6:
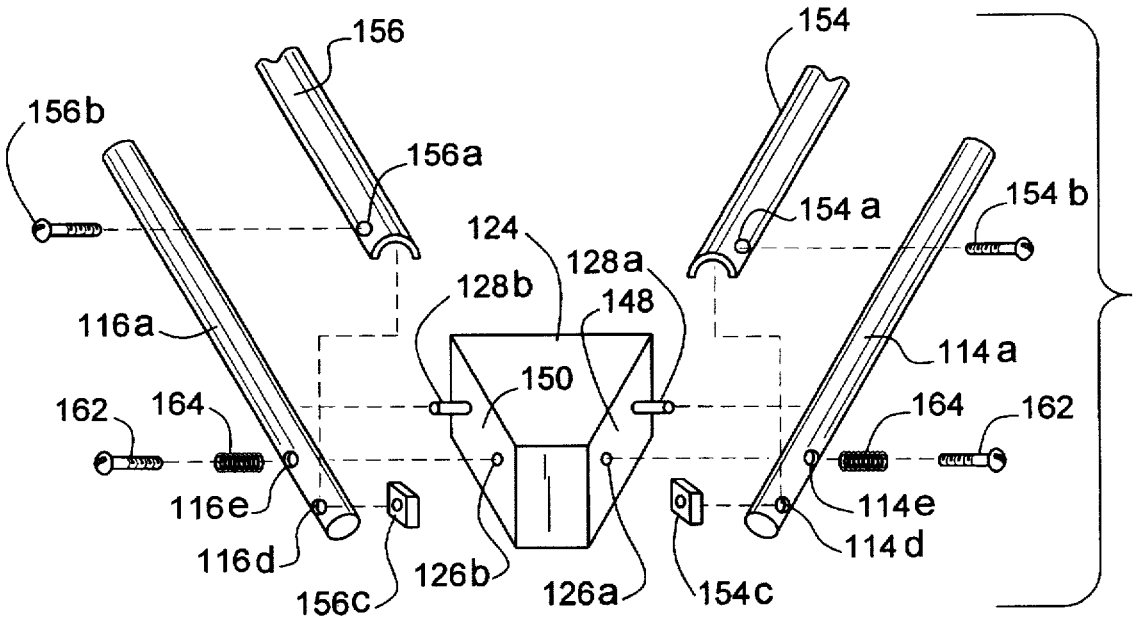
FIG. 6 is an exploded view of a portion of the top end of the embodiment of FIG. 5.

As shown in FIGS. 5 and 6, tubular bag support arms 114 and 116 are pivotally attached to opposite sides of pivot assembly 124 which is mounted onto the upper end of the tubular member 112b. The tubular bag support arms 114 and 116 generally include two tubular sections in telescoping relationship in each arm 114, 116. The support arm 114 includes a first tubular support member 114a which receives a second tubular member 114b therein and support member 116 includes a first tubular member 116a which has a diameter sufficiently greater than the diameter of tubular member 116b so as to receive the second tubular member 116b therein. Caps 114c and 116c are also provided on the outer end of tubular members 114b and 116b, respectively, to provide safety means for users of the bag holder 110.

The pivot assembly 124 is shown as a trapezoidal-shaped block member mounted onto the upper end of tubular member 112b. As best shown in FIG. 6, the trapezoidal-shaped pivot assembly 124 is provided with non-parallel edges 148 and 150 to which the pivotal bag support arms 114 and 116, respectively, are mounted. The non-parallel edges 148 and 150 are angular disposed in relation to each other so that a collapsible bag can be mounted onto and between the tubular bag support arms 114 and 116. The means for mounting a collapsible bag, shown in phantom lines in FIG. 5, will be discussed hereinafter. A preferred angular relationship between arms 114 and 116 is generally about 60° but other angular relationships between arms 114 and 116 may also be used.

As best shown in FIG. 6, tubular members 114a and 116a are pivotally attached to the trapezoidal-shaped pivot assembly 124 by bolts 162 with compression springs 164 thereon.

Figure 7:
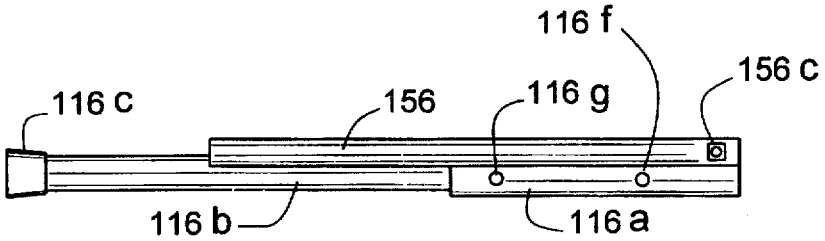
FIG. 7 is a side view of a portion of the top end of FIG. 5.

Tubular members 114*a* and 116*a* are provided with aligned apertures therein which are sized to receive the bolts 162 therethrough and the pivot assembly 124 is also provided with threaded apertures 126*a*, 126*b* therein to receive the bolts 162. As shown in FIGS. 6 and 7, the tubular member 116*a* is provided with an aperture 116*e* and an opposed aperture 116*f* (FIG. 7) which is in alignment therewith for receiving the threaded bolt 162 therethrough. Tubular member 114*a* is provided with opposed aligned apertures, only one being shown and identified by the numeral 114*e* in FIG. 6, and an opposed aligned opening similar to the opening 116*f* as shown in FIG. 7 for receiving the bolt 162 therethrough. In horizontal alignment with the openings 126*a* and 126*b* in the pivot assembly 124 are spaced horizontally aligned fingers 128*a* and 128*b* for mating relation with openings disposed in the tubular members 114*a* and 116*a* for maintaining the bag support arms 114 and 116 in horizontal alignment. As shown in FIG. 7, tubular member 116*a* is provided with an opening 116*g* therein which is in horizontal alignment with the opening 116*f*, the opening 116*g* being to receive the finger 128*b* therein. Tubular member 114*a* has a corresponding opening 116*g* (not shown) for receiving finger 128*a* therein.

The bag support arms 114 and 116 are also provided with pivotally attached arcuate-shaped clamping members 154 and 156, respectively, for use in clamping the lip of the opening of a collapsible bag onto the tubular support members 114*a*, 114*b* and 116*a*, 116*b*. The clamping member 154 is pivotally attached to the tubular member 114*a* by a threaded bolt 154*b* which is received through aligned openings 154*a* in clamping member 154 and openings 114*d* in tubular member 114, only one opening 114*d* being shown. A nut 154*c* is provided to receive bolt 154*b*. The clamping member 156 is pivotally attached to the tubular member 116*a* by a threaded bolt 156*b* which is received through opening 156*a* in clamping member 156 and aligned openings 116*b* in tubular member 116*a*, only one aligned opening 116*d* being shown. Nut 156*c* is provided for receiving the bolt 156*b*.

In clamping a collapsible bag to the tubular support members 114*a*, 114*b* and 116*a*, 116*b*, clamping members 154 and 156 are raised upwardly as shown by the broken lines in FIG. 5 and the top of the opening for a collapsible bag, as shown in phantom lines in FIG. 5, is draped over the tubular members and 116*a*, 116*b* and the clamping members 154 and 156 which are of arcuate cross-section having an inside diameter substantially the same as the outer diameter of the tubular members 114*a* and 116*a*, respectively, are then snapped onto the tubular members 114*a* and 116*a*, respectively. In a preferred embodiment, the clamping members 154 and 156 are slightly longer than the tubular members 114*a* and 116*a*, respectively, to which the clamping members 154, 156 are clamped thereon, the lip of the plastic bag being sandwiched between the clamping members 154 and 156 and the tubular members 114*a*, 116*a*.

Returning to FIG. 5, the vertical support 112 is provided with a second trapezoidal configured pivot assembly 134 which is fixedly attached to the ground end of the lower tubular member 112*a*. Pivot assembly 134 is similar in configuration and construction to the pivot assembly 124 discussed hereinbefore. Pivotally attached to the assembly 134 are ground end support feet 144 and 146 which are pivotally mounted with pivot screw 162*b* to the non-parallel sides of the trapezoidal configured pivot assembly 134. The ground end support foot 144 includes a first tubular support member 144*a* which receives a second tubular member 144*b* in telescoping relation therein and ground end support foot 146 includes a first tubular member 146*a* which has a diameter slightly greater than the diameter of a second tubular member 146*b* so as to receive the second tubular member 146*b* in telescoping relation therein. Caps 144*c* and 146*c* are provided on the outer ends of tubular members 144*b* and 146*b*, respectively, to protect users from scraping against the outer ends of the tubular members 144*b* and 146*b*.

Figure 8:
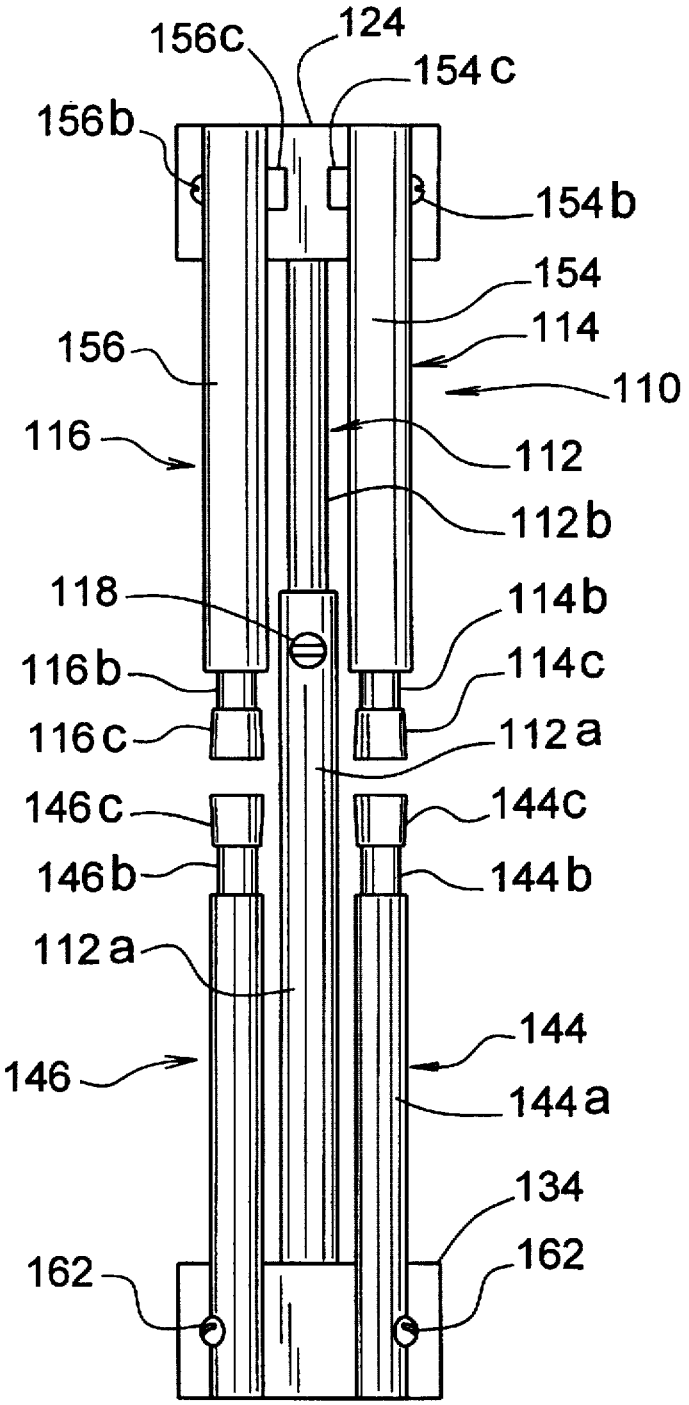
FIG. 8 is a side view of the embodiment of FIG. 5 in a storage position; and, FIG. 9 is a perspective view of even another preferred embodiment of the present invention.

As shown in FIG. 8, because of the telescoping vertical support member 112 and the telescoping bag support arms 114, 116 and the telescoping ground end support feet 144, 146 and the pivoting arrangement of the arms 114, 116 and feet 144, 146, bag holder 110 may be folded into a relatively compact position for storage.

In the use of the bag holder 110, as shown in FIGS. 5–8, the feet 144 and 146 are pivoted downwardly and locked into position by the mating relationship between the pivot assembly 134 and the tubular member 144*a* and 146*a*. The locking relationship between feet 144, 146 and assembly 134 being similar to the locking arrangement of arms 114, 116 and assembly 124. (The arrangement of the locking fingers and openings being shown in FIG. 6 and identified by fingers 128*a* on one side of the pivot assembly and 128*b* on the opposite side of the pivot assembly for receipt into openings similar to 116*g*, as shown in FIG. 7.) Tubular members 144*b* and 146*c* are then telescopically positioned as desired. If the support member 112 is not unitary, but in sections 112*a* and 112*b*, as shown, the vertical height adjustment of the bag holder 110 is then adjusted by telescopically positioning tubular member 112*b* to a preselected height and then tightening down on locking bolt 118 to lock the position of the tubular member 112*b* in relationship to 112*a*. The bag supports arm 114 and 116 are then swung upwardly into a use position, locking the tubular member 114*a* to the edge 146 of pivot assembly 124 by inserting the finger 128*a* into the opening similar to 116*g* of tubular member 116*a* (FIG. 7) and then locking the tubular member 116*a* to the edge 150 of the pivot assembly 124 with the finger 128*b* being received within the opening 116*g* (FIG. 7). Tubular members 114*b* and 116*d* are then telescopically positioned at a preselected length as so to receive the lip of the opening of a collapsible bag thereon. Clamping members 154 and 156 are pivoted upwardly, as shown in FIG. 5, and the lip of a collapsible bag is then laid across the tubular members 114*a*, 114*b* and 116*a* and 116*b*. Upon positioning of the lip of the collapsible bag over the tubular members, the clamping members 154 and 156 are then snapped onto the tubular members 114*a* and 116*a*, respectively, thereby sandwiching the lip of the collapsible bag therebetween.

Figure 9:
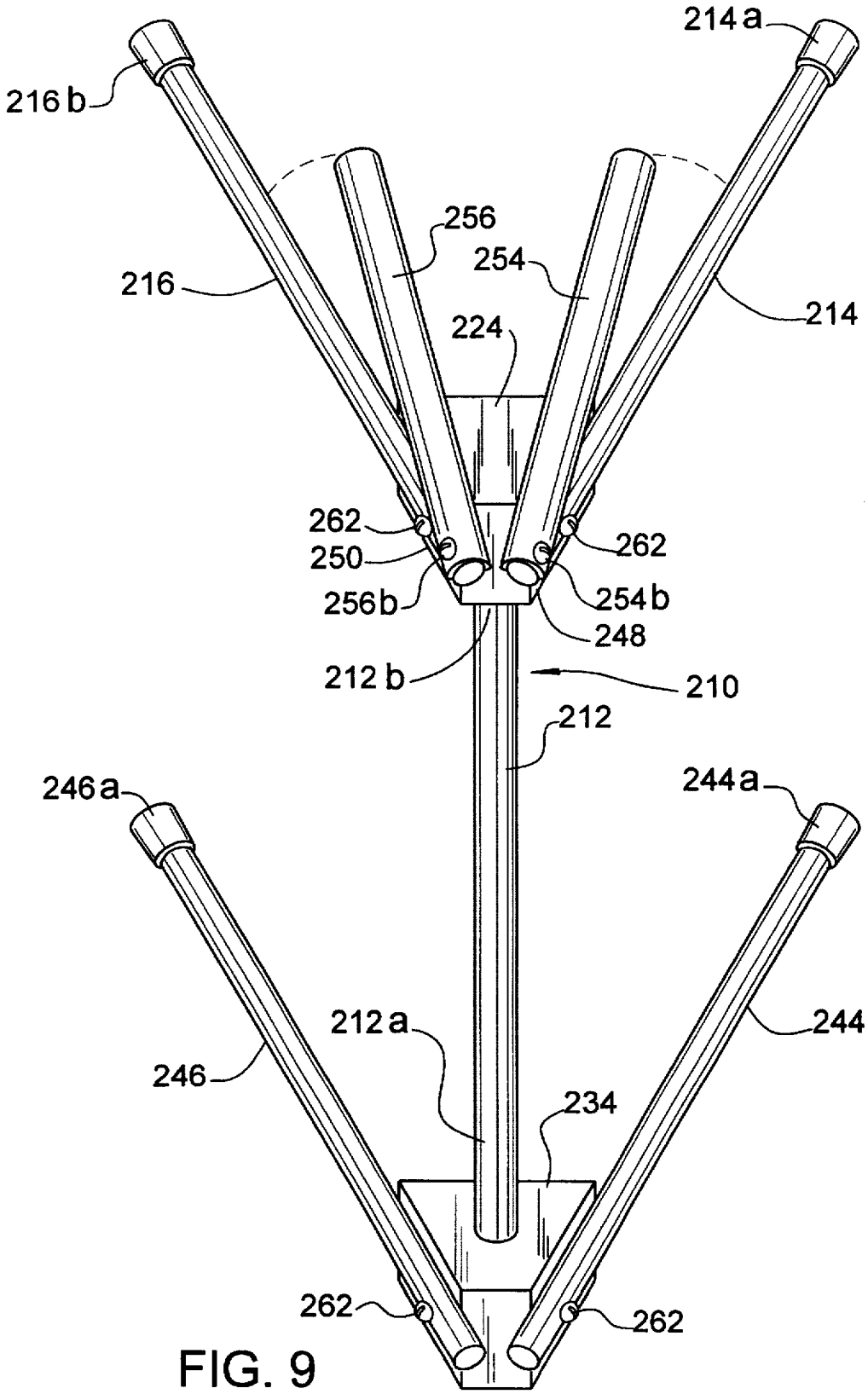

Now turning to FIG. 9, there is shown another preferred embodiment of a bag holder of the present invention. The bag holder is denoted by the numeral 210. The bag holder 210 includes a longitudinally extending support 212 of preselected length, generally about the length of a plastic bag for gathering leaves. The lower or ground end of the support member 212 is identified by the numeral 212*a* and the upper or tubular bag support end is identified by the numeral 212*b*. Preferably, and as shown, the support member 212 is of circular cross-section. It is realized that other cross-sectional configurations, such as a rectangular support member, may also be used.

Tubular bag support arms 214 and 216 are provided and are pivotally attached to opposite sides of a pivot assembly 224 which is mounted onto the upper end of the support member 212*b*. Caps 214*a* and 216*b* are also provided on the outer end of tubular members 214 and 216, respectively, to provide safety means for users of the bag holder 210.

The pivot assembly 224 is shown as a trapezoidal-shaped block member mounted onto the upper end 212*b* of support member 212. The trapezoidal-shaped pivot assembly 224 is provided with non-parallel edges 248 and 250 to which the pivotal bag support arms 214 and 216, respectively, are mounted. The non-parallel edges 248 and 250 are angular disposed in relation to each other so that a collapsible bag can be mounted onto and between the tubular bag support arms 214 and 216. A preferred angular relationship between arms 214 and 216 is generally about 60° but other angular relationships between arms 214 and 216 may also be used.

Bag support arms 214 and 216 are pivotally attached to the trapezoidal-shaped pivot assembly 224 by bolts 262 with compression springs similar to springs 164 in FIG. 6 thereon. Support arms 214 and 216 are provided with aligned apertures therein which are sized to receive the bolts 262 therethrough and the pivot assembly 224 is also provided with threaded apertures (not shown) therein to receive the bolts 262. The bag support arm 216 is provided with opposed apertures similar to apertures 116*e* and 116*f* as shown in FIG. 7 for receiving the threaded bolt 262 therethrough. Support arm 214 is provided with opposed aligned apertures similar to aperture 114*e* as shown in FIG. 6 and an opposed aligned opening similar to the opening 116*f* as shown in FIG. 7 for receiving the bolt 262 therethrough. Pivot assembly 224 is identical to the pivot assembly 124 as shown in FIG. 6. Thus, for maintaining support arms 214 and 216 in horizontal alignment openings 126*a* and 126*b* in the pivot assembly 124 are spaced from horizontally aligned fingers 128*a* and 128*b* for mating relation with openings disposed in the bag support arms 214 and 216.

The bag support arms 214 and 216 are also provided with pivotally attached arcuate-shaped clamping members 254 and 256, respectively, for use in clamping the lip around the opening of a collapsible bag onto the support arms 214 and 216. The clamping member 254 is pivotally attached to the support arm 214 by a threaded bolt 254*b* which is received through aligned openings (not shown) in clamping member 254 and openings (not shown) in support arm 214. The clamping member 256 is pivotally attached to the bag support arm 216 by a threaded bolt 256*b* which is received through opening (not shown) in clamping member 256 and aligned openings (not shown) in bag support arm 216.

In clamping a collapsible bag to the bag support arms 214 and 216, clamping members 254 and 256 are raised upwardly as shown by the broken lines in FIG. 9 and the top of the opening for a collapsible bag, similar to the one as shown in phantom lines in FIG. 5, is draped over the support arms 214 and 216 and the clamping members 254 and 256 which are of arcuate cross-section having an inside diameter substantially the same as the outer diameter of the bag support arms 214 and 216, respectively, are then snapped onto the arms 214 and 216.

The vertical support 212 is provided with a second trapezoidal configured pivot assembly 234 which is fixedly attached to the ground end 212*a* of the support member 212. Pivot assembly 234 is similar in configuration and construction to the pivot assembly 224 discussed hereinbefore. Pivotally attached to the assembly 234 are ground end support feet 244 and 246 which are pivotally mounted with pivot screws 162*b* to the non-parallel sides of the trapezoidal configured pivot assembly 234. Caps 244*a* and 246*a* are provided on the outer ends of feet 244 and 246, respectively, to protect users from scraping against the outer ends of the feet 244 and 246.

Although particular embodiments of the present invention have been shown and described herein, there is no intention to unduly limit the invention to the specific details of the embodiment. Thus, it will become apparent to those skilled in the art that various changes and modifications may be made herein without departing from the spirit and scope of the present invention as set forth in the claims appended hereto

What is claimed is:

1. A collapsible bag holder comprising:

longitudinally extending support means having a ground support end and a bag support end opposite said ground support end;

a pair of pivotally mounted bag support arms mounted on opposite sides of said bag support end of said longitudinally extending support means;

a bag support mounting assembly mounted onto the bag support end of said longitudinally extending support means, each bag support arm being mounted on opposite sides of said bag support mounting assembly, said bag support mounting assembly being a block-shaped member of trapezoidal configuration, said bag support arms being mounted on opposed non-parallel sides of said block shaped members, the angle between said opposed non-parallel sides being approximately 60°, and, a ground support assembly attached to said ground support end.

2. The bag holder of claim 1 including a transversely extending bar attached to said ground support end.

3. The bag holder of claim 1, said ground support assembly including a spike.

4. The bag holder of claim 1, said longitudinally extending support means including at least two tubular support members, one received within the other in telescoping relation.

5. The bag holder of claim 4 including locking means to lock said tubular support members in a preselected position.

6. The holder of claim 1, each of said pivotally mounted bag support arms including at least two tubular members for each bag support arm wherein one of said tubular members is telescopingly received within the other.

7. The bag holder of claim 6 including locking means to lock said tubular members at preselected positions in relation to each other.

8. The trash bag holder of claim 1, each of said bag support arms having a pivotally attached clamping member.

9. The bag holder of claim 8, said bag support arms including at least one tubular bag support member with an outer surface configuration the same size and shape as an inner clamping surface of said clamping member.

10. The bag holder of claim 9, said tubular bag support member being of circular cross-section and said clamping member being arcuate with an inner surface of substantially the same radius as the radius of curvature of an outer surface of said tubular bag support member.

11. The bag holder of claim 1, said ground support assembly comprising a block-shaped feet support mounting block attached to said ground end and at least two feet pivotally attached to said feet support mounting block.

12. The bag holder of claim 11, said feet support mounting block being of trapezoidal configuration, said feet being mounted on opposed non-parallel sides of said mounting block.

13. The bag holder of claim 11, each of said feet including at least two tubular members mounted in telescoping relation.

14. A collapsible bag holder comprising:

longitudinally extending support means having a ground support end and a bag support end opposite said ground support end;

a pair of pivotally mounted bag support arms mounted on opposite sides of said bag support end of said longitudinally extending support means;

a bag support mounting assembly mounted onto the bag support end of said longitudinally extending support means, each bag support arm being mounted on opposite sides of said bag support mounting assembly, said bag support mounting assembly being a block-shaped member with outwardly extending flanged portions on opposite sides thereof, said outwardly extending flanged portions being positioned to support said bag support arms in use and non-use positions; and a ground support assembly attached to said around support end.

15. The bag holder of claim 14 including means to hold said bag support arms in contacting relation with one edge of said bag support mounting assembly in use and non-use positions.

16. The bag holder of claim 14 wherein said block shaped member is of trapezoidal configuration with the outwardly extending flanged portions being in angular relationship to each other.

17. The bag holder of claim 14 wherein said angular relationship between said outwardly extending flanged members is about 60°.

* * * * *